US005688620A

United States Patent [19]

Fujita et al.

[11] Patent Number: 5,688,620

[45] Date of Patent: Nov. 18, 1997

[54] ELECTROPHOTOGRAPHIC PHOTORECEPTOR CONTAINING A RESIDUAL CHARGE-SUPPRESSING FATTY ACID ESTER IN THE PHOTOCONDUCTIVE LAYER

[75] Inventors: Yoshimasa Fujita, Tenri; Kazushige Morita, Kitakatsuragi-gun, both of Japan

[73] Assignee: Sharp Kabushiki Kaisha, Japan

[21] Appl. No.: 644,821

[22] Filed: May 10, 1996

[30] Foreign Application Priority Data

May 24, 1995 [JP] Japan ..... 7-125241

[51] Int. Cl.[6] ..... G03G 5/04

[52] U.S. Cl. ..... 430/59; 430/96

[58] Field of Search ..... 430/58, 59, 96

[56] References Cited

U.S. PATENT DOCUMENTS

| | | | |
|---|---|---|---|
| 5,035,968 | 7/1991 | Horie et al. | 430/59 |
| 5,336,582 | 8/1994 | Takegawa et al. | 430/59 |
| 5,547,791 | 8/1996 | Ishio et al. | 430/59 |

FOREIGN PATENT DOCUMENTS

| | | |
|---|---|---|
| 4-250458 | 9/1992 | Japan . |
| 5-27458 | 2/1993 | Japan . |

*Primary Examiner*—John Goodrow

*Attorney, Agent, or Firm*—Nixon & Vanderhye

[57] ABSTRACT

Disclosed is an electrophotographic photoreceptor which gives a very low residual potential and scarcely accumulates the residual potential even by repeated use and which varies very slightly in a charging property and sensitivity and has a very excellent stability. The electrophotographic photoreceptor has a conductive support and a photoconductive layer provided on the conductive support. The photoconductive layer contains a charge-generating material, a charge-transporting material, a binder resin and a fatty acid ester compound represented by the following Formula (1):

$$\begin{array}{l} \qquad\qquad\quad OCOR_1 \\ \qquad\qquad\quad | \\ HC-CH_2CH(CH_2)nR_2 \\ \| \\ HC-(CH_2)mCOOR_3 \end{array} \qquad (1)$$

wherein $R_1$, $R_2$ and $R_3$ each represent hydrogen or a saturated or unsaturated aliphatic hydrocarbon group which may have substituents, and n and m each represent an integer of 1 to 10.

17 Claims, 2 Drawing Sheets

ELECTROPHOTOGRAPHIC PHOTORECEPTOR CONTAINING A RESIDUAL CHARGE-SUPPRESSING FATTY ACID ESTER IN THE PHOTOCONDUCTIVE LAYER

BACKGROUND OF THE INVENTION (1) Field of the Invention

The present invention relates to an electrophotographic photoreceptor applied to electrostatic transfer type copying machines and electrophotographic apparatuses such as a laser beam printer, more specifically to an electrophotographic photoreceptor having a very excellent durability.

(2) Description of the Prior Art

In recent years, because of a lot of excellent techniques involved in electrophotographic techniques, they have been widely used and applied not only in the field of copying machines but also in the field of various printers. Electrophotographic photoreceptors (hereinafter referred to as a photoreceptor) which is the nucleus of electrophotographic techniques can be divided roughly into photoreceptors using inorganic materials and photoreceptors using organic materials as photoconductive materials.

Typical photoreceptors using inorganic materials include selenium series products such as amorphous selenium (a—Se) and amorphous selenium arsenic (a-$As_2Se_3$), products obtained by dispersing pigment-sensitized zinc oxide (ZnO) or cadmium sulfide (CdS) in resins, products using amorphous silicon (a—Si), and the like.

Typical photoreceptors using organic materials include products using a charge-transfer complex of 2,4,7-trinitro-9-fluorenone (TNF) with poly-N-vinylcarbazole (PVK).

In recent years, attentions have been paid to the photoreceptors using organic materials as one of the most important photoreceptors since they have advantages such as no public pollutions and easiness in the film formation and the production, and the durability has been enhanced.

However, the photoreceptors using the organic materials have the problem of low sensitivities. Accordingly, it has been attempted to improve them, and various sensitizing methods have been proposed. Among them, multi-layered type photoreceptors (hereinafter referred to as double-layered photoconductive structures) comprising a layer (hereinafter referred to as a charge-generating layer) containing a material which generates charge carriers when irradiated with light (hereinafter referred to as a charge-generating material)and a layer (hereinafter referred to as a charge-transporting layer) containing a material which accepts the charge carriers produced in the charge-generating layer and transports them (hereinafter referred to as a charge-transporting material) show excellent sensitivities. Further, this kind of photoreceptors have a wide range of selecting the materials, a high safety and a high productivity in applying, and are relatively advantageous in terms of the cost. Accordingly, they occupy a leading position in the organic photoreceptors at present.

However, the double-layered photoconductive structures which have been put to practical use at present show a reduction in the charge potential, an increase in the residual potential, a variation in the sensitivities and the like in terms of electrical characteristics when repeatedly using them, and therefore it is not necessarily reasonable to say that they are sufficiently satisfactory in terms of a potential stability. In particular, an increase in the residual potential brings about problems such as high background density and becomes a large factor for preventing the organic photoreceptors from having a high printing resistance. Several matters can be the factors for an increase in the residual potential, and among them, the factor which is supposed to exert the largest effect is impurities present in a charge-transporting layer. Given as the impurities described above are substances inherently present in compositions and decomposition products formed by repeated exposure of corona discharge (ozone, collision of charged particles, UV rays, and the like) or by repeated exposure of light for images and Erase lamp. That is, such impurities are supposed to increase the residual potential by turning into traps and capturing carriers to form immovable space charges.

Accordingly, in order to remove the factors described above, it has been attempted to suppress an increase in the residual potential in repeated use not only by means of improvement such as a removal of the impurities and an enhancement in the stability of the compositions but also by adding various additives to a charge-transporting layer. However, the additives disclosed in Japanese Patent Application Laid-Open No. Hei 5-27458 and the like have not yet been sufficiently effective, and adverse effects such as a reduction in the charging property and a variation in the sensitivity caused by repeated use have been increased.

SUMMARY OF THE INVENTION

Accordingly, an object of the present invention is to provide an electrophotographic photoreceptor which gives a very low residual potential and scarcely accumulates the residual potential even by repeated use and which varies very slightly in a charging property and sensitivity and has a very excellent stability.

According to one aspect of the present invention, provided is an electrophotographic photoreceptor comprising: a conductive support; and a photoconductive layer provided on the above conductive support and containing a charge-generating material, a charge-transporting material, a binder resin and a fatty acid ester compound represented by the following Formula (1):

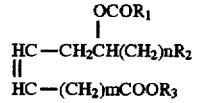

$$\begin{array}{l} \quad\quad\quad\quad OCOR_1 \\ \quad\quad\quad\quad | \\ HC-CH_2CH(CH_2)nR_2 \\ \| \\ HC-(CH_2)mCOOR_3 \end{array} \quad (1)$$

wherein $R_1$, $R_2$ and $R_3$ each represent hydrogen or a saturated or unsaturated aliphatic hydrocarbon group which may have substituents, and n and m each represent an integer of 1 to 10.

According to a so-called single layer type electrophotographic photoreceptor having the construction described above, there is an effect to suppress the accumulation of carriers in the photoconductive layer, which makes it possible to obtain an electrophotographic photoreceptor which shows a very low residual potential and scarcely accumulates the residual potential even when repeatedly used and which varies very slightly in a charging property as well as sensitivity and has a very excellent stability.

According to another aspect of the present invention, provided is an electrophotographic photoreceptor comprising: a conductive support; and a photoconductive layer provided on the above conductive support, and the photoconductive layer comprising: a charge-generating layer which contains a charge-generating material; and a charge-transporting layer which contains a charge-transporting material, a binder resin and a fatty acid ester compound represented by the following Formula (1):

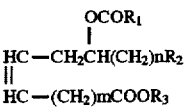

(1)

wherein $R_1$, $R_2$ and $R_3$ each represent hydrogen or a saturated or unsaturated aliphatic hydrocarbon group which may have substituents, and n and m each represent an integer of 1 to 10.

According to so-called double-layered photoconductive structures (function-separated type or multi-layered electrophotographic photoreceptor) having the construction described above, there is an effect to suppress the accumulation of carriers in the charge-transporting layer, which makes it possible to obtain an electrophotographic photoreceptor which shows a very low residual potential and scarcely accumulates the residual potential even when repeatedly used and which varies very slightly in a charging property and sensitivity and has a very excellent stability.

Further advantages and features of the present invention as well as the scope, nature and utilization of the present invention will become apparent to those averagely skilled in the art from the descriptions of the preferred embodiments of the present invention set forth below.

DESCRIPTION OF THE PREFERRED EMBODIMENTS

The electrophotographic photoreceptor according to the present invention will be explained in detail with reference to the figures.

In the electrophotographic photoreceptor according to the present invention, a photoconductive layer is provided on a conductive support. Used as the conductive support are metal materials such as aluminum, stainless steel, copper and nickel, and insulating supports such as polyester films and paper on the surface of which there are provided conductive layers of aluminum, copper, palladium, tin oxide, indium oxide-or the like. The photoconductive layer is usually formed by providing a charge-generating layer and a charge-transporting layer in this order, but this order can be changed. Further, as the photoconductive layer, there may be formed a single layer containing a charge-generating material and a charge-transporting material.

Figure 1:
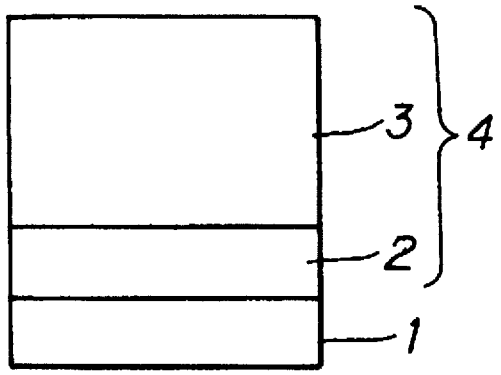
FIG. 1 is a schematic cross-sectional view showing an embodiment of the double-layered photoconductive structures of the present invention.

FIG. 1 is a schematic cross-sectional view showing one embodiment of the double-layered photoconductive structures of the present invention. As shown in FIG. 1, the double-layered photoconductive structures are prepared by forming a photoconductive layer 4 on a conductive support 1, and the photoconductive layer 4 is formed by providing a charge-transporting layer 3 on a charge-generating layer 2.

As the charge-generating material contained in the charge-generating layer, there can be used: inorganic photoconductive materials such as selenium, alloys thereof, arsenic-selenium, cadmium sulfide, zinc oxide and amorphous silicon; organic pigments such as phthalocyanines, azo pigments, quinacridone, polycyclic quinones and perylene; and dyes such as pyrylium salts, thiapyrylium salts, squalilium salts, indigo, thioindigo, anthanthrone, pyranthrone and cyanines. These substances may be used in combination of two or more kinds thereof.

The charge-generating layer may be used in the form of a dispersed layer in which the fine particles of these substances are bound with various binder resins such as polyvinyl acetate, polyacrylic acid ester, polymethacrylic acid ester, polyester resins, polycarbonate, polyarylate, polyvinylbutyral, phenoxy resins, epoxy resins, urethane resins, cellulose esters and cellulose ethers. These binder resins may be used in combination of two or more kinds thereof. The use proportion of the charge-generating material to the binder resin falls usually in a range of 1 to 500 parts by weight based on 100 parts by weight of the binder resin. The charge-generating layer has usually a thickness of 0.05 to 5 μm, preferably 0.1 to 1 μm. Further, the charge-generating layer may contain, if necessary, various additives such as leveling agents for improving the coating property, antioxidants and sensitizers. The charge-generating layer may be a film on which the charge-generating materials described above are deposited.

The charge-transporting layer is composed fundamentally of a fatty acid ester compound represented by the following Formula (1) as well as the charge-transporting material and the binder resin:

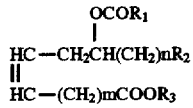

(1)

In Formula (1), $R_1$, $R_2$ and $R_3$ represent independently hydrogen or a saturated or unsaturated aliphatic hydrocarbon group which may have substituents, and n and m each represent an integer of 1 to 10.

Next, the principal concrete examples of the fatty acid ester compound represented by Formula (1) are shown in Tables 1 and 2, but the present invention will not be restricted to these compounds.

TABLE 1

| Exemplified compound | Substituents in Formula (1) | | | | |
|---|---|---|---|---|---|
| No. | $R_1$ | $R_2$ | $R_3$ | n | m |
| 1 | —H | —H | —H | 1 | 3 |
| 2 | —H | —H | —H | 2 | 4 |
| 3 | —H | —H | —H | 3 | 5 |
| 4 | —H | —H | —H | 4 | 6 |
| 5 | —H | —H | —H | 5 | 7 |
| 6 | —H | —H | —H | 6 | 8 |
| 7 | —H | —H | —H | 7 | 9 |

TABLE 2

| Exemplified compound | Substituents in Formula (1) | | | | |
|---|---|---|---|---|---|
| No. | $R_1$ | $R_2$ | $R_3$ | n | m |
| 8 | $—CH_3$ | $—CH_3$ | $—CH_3$ | 1 | 3 |
| 9 | $—CH_3$ | $—CH_3$ | $—CH_3$ | 2 | 4 |
| 10 | $—CH_3$ | $—CH_3$ | $—CH_3$ | 3 | 5 |
| 11 | $—CH_3$ | $—CH_3$ | $—CH_3$ | 4 | 6 |
| 12 | $—CH_3$ | $—CH_3$ | $—CH_3$ | 5 | 7 |

TABLE 2-continued

| Exemplified compound | Substituents in Formula (1) | | | | |
|---|---|---|---|---|---|
| No. | $R_1$ | $R_2$ | $R_3$ | n | m |
| 13 | $-CH_3$ | $-CH_3$ | $-CH_3$ | 6 | 8 |
| 14 | $-CH_3$ | $-CH_3$ | $-CH_3$ | 7 | 9 |

The charge-transporting material is an electron-donating substance, representative examples thereof include: heterocyclic compounds such as carbazole, indole, imidazole, oxazole, pyrazole, oxadiazole, pyrazoline, thiadiazole and mixtures thereof; aniline derivatives, hydrazone compounds, aromatic amine derivatives, stilbene derivatives, polymers having groups comprising these compounds on main chains or side chains, and mixtures thereof. The binder resin used for the charge-transporting layer includes, for example, vinyl polymers such as polymethyl methacrylate, polystyrene and polyvinyl chloride, copolymers thereof, polycarbonate, polyester resins, polyester carbonates, polysulfones, polyimides, phenoxy resins, epoxy resins, silicone resins. Further, the mixtures thereof or the partially cross-linked polymers thereof can be used as well. A proportion in which the fatty acid ester compound represented by Formula (1) is added to the charge-transporting layer falls, in terms of a proportion to the binder resin, usually in a range of 0.001 to 10 parts by weight, preferably 0.01 to 5 parts by weight based on 100 parts by weight of the binder resin. The proportion smaller than this range does not provide the effect of suppressing the accumulation of the residual potential. Meanwhile, the proportion exceeding this range no longer varies the effect of suppressing the residual potential. A proportion of the charge-transporting material to the binder resin falls in a range of 30 to 200 parts by weight, preferably 40 to 150 parts by weight based on 100 parts by weight of the binder resin.

Further, the charge-transporting layer may contain, if necessary, various additives such as leveling agents for improving the coating property, antioxidants and sensitizers. The charge-transporting layer has a thickness of 5 to 50 μm, preferably 10 to 45 μm. An overcoating layer comprising main components of, for example, well known thermoplastic or thermosetting polymers may be provided as an uppermost layer. Further, a barrier layer may be provided between the conductive support and the photoconductive layer.

Used as the barrier layer is: an inorganic layer comprising inorganic compounds such as an aluminum anodic oxide film, aluminum oxide, aluminum hydroxide, and titanium oxide and mixtures thereof; an organic layer comprising organic polymers such as polyvinyl alcohol, casein, polyvinylpyrrolidone, polyacrylic acid, celluloses, gelatin, starch, polyurethane, polyimides, polyamides and mixtures thereof; or a layer comprising the mixtures of these inorganic compounds and organic polymers.

There can be applied as forming methods for the respective layers, such known methods as dissolving or dispersing substances to be added to the layers in solvents and applying in order the resulting coating solutions.

Figure 2:
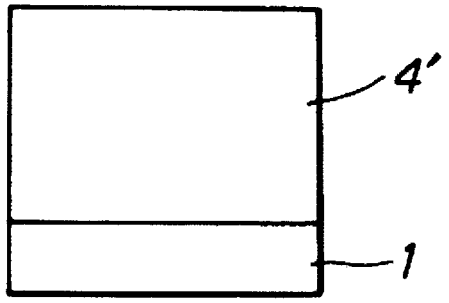
FIG. 2 is a schematic cross-sectional view showing an embodiment of the single layer type photoreceptor of the present invention.

FIG. 2 is a schematic cross-sectional view showing one embodiment of the single layer type photoreceptor according to the present invention. As shown in FIG. 2, the single layer type photoreceptor is prepared by forming a photoconductive layer 4' on a conductive support 1, and this photoconductive layer 4' is formed by dispersing a charge-generating material and a charge-transporting material in the binder resin used for the charge-transporting layer of the double-layered photoconductive structures described above. The conductive support, the charge-generating material and the charge-transporting material used for preparing the single layer type photoreceptor are the same as those used for preparing the double-layered photoconductive structures described above. Also in case of the single layer type photoreceptor, the barrier layer described above may be provided between the conductive layer and the photoconductive layer. Forming methods for the respective layers are the same as those described above.

EXAMPLES

The present invention will be explained below in further details with reference to examples and comparative examples but will not be restricted thereto.

Example 1

The mixture of a bisazo series pigment (chlorodian blue) of 1.5 parts by weight represented by the following formula (I) and a phenoxy resin (PKHH: manufactured by Union Carbide Co., Ltd.) of 1.5 parts by weight was dispersed in 1,2-dimethoxyethane of 97 parts by weight for 8 hours with a paint shaker, and the resulting coating solution for a charge-generating layer was applied with a Baker applicator on a polyester film 1 deposited with aluminum of 100 μm, followed by carrying out hot-air drying at a drying temperature of 90° C. for 10 minutes, whereby a charge-generating layer 2 (refer to FIG. 1) having a dry film thickness of 0.8 μm was provided. Further, applied thereon with the Baker applicator was a coating solution for a charge-transporting layer prepared by dissolving a hydrazone series compound of 100 parts by weight represented by the following formula (II), polycarbonate (Eupiron Z-400: manufactured by Mitsubishi Gas Chemical Co., Ltd.) of 100 parts by weight and the fatty acid ester compound of an exemplified compound No. 12 [following formula (III)] of 0.1 part by weight in dichloromethane of 800 parts by weight by stirring with a magnetic stirrer, and then hot-air drying was carried out at a drying temperature of 80° C. for one hour to provide a charge-transporting layer 3 having a dry film thickness of 23 μm, whereby double-layered photoconductive structures were prepared as shown in FIG. 1.

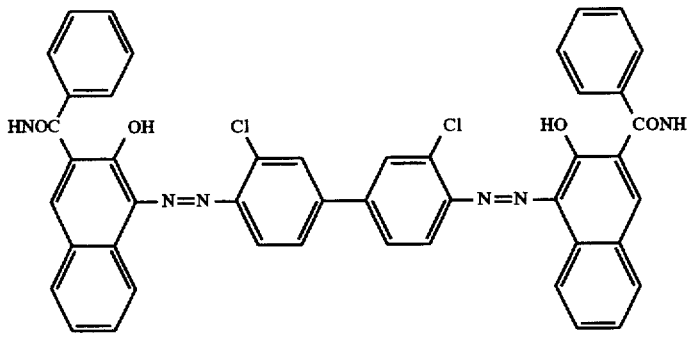

(I)

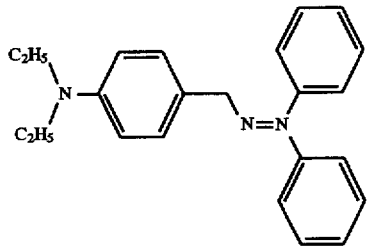

(II)

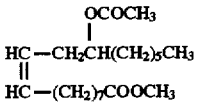

(III)

The electrophotographic photoreceptor thus prepared was loaded in a commercial apparatus (SF-8870: manufactured by Sharp Co., Ltd.) to determine a surface potential of the photoreceptor in a developing part, concretely a surface potential ($V_O$) of the photoreceptor in the dark excluding an exposing process in order to observe the charging property, a surface potential ($V_R$) of the photoreceptor after removing the potential and a surface potential ($V_L$) of the photoreceptor on the background when exposed in order to observe the sensitivity.

The initial characteristics of the electrophotographic photoreceptors obtained in the examples and the characteristics thereof after the repeated operation of 40,000 cycles were determined in the respective environmental conditions of normal temperature/normal humidity (hereinafter, referred to as N/N) of 25° C./60% RH and high temperature/high humidity (hereinafter, referred to as H/H) of 35° C./85% RH.

The results thereof are shown in Table 3.

TABLE 3

| Example | Fatty acid ester exemplified compound | Measuring environment | Initial (V) $V_O$ | Initial (V) $V_R$ | Initial (V) $V_L$ | After 40,000 cycles (V) $V_O$ | After 40,000 cycles (V) $V_R$ | After 40,000 cycles (V) $V_L$ |
|---|---|---|---|---|---|---|---|---|
| 1 | 1 | N/N | −710 | −5 | −142 | −703 | −8 | −140 |
| | | H/H | −724 | −11 | −136 | −722 | −15 | −137 |

Example 2

The electrophotographic photoreceptor was prepared in the same manner as that in Example 1, except that the amount of the fatty acid ester compound of the exemplified compound No. 12 was varied in a range of from 0.001 part by weight to 10 parts by weight, and the electrophotographic characteristics were determined in the same manner as that in Example 1.

Figure 3:
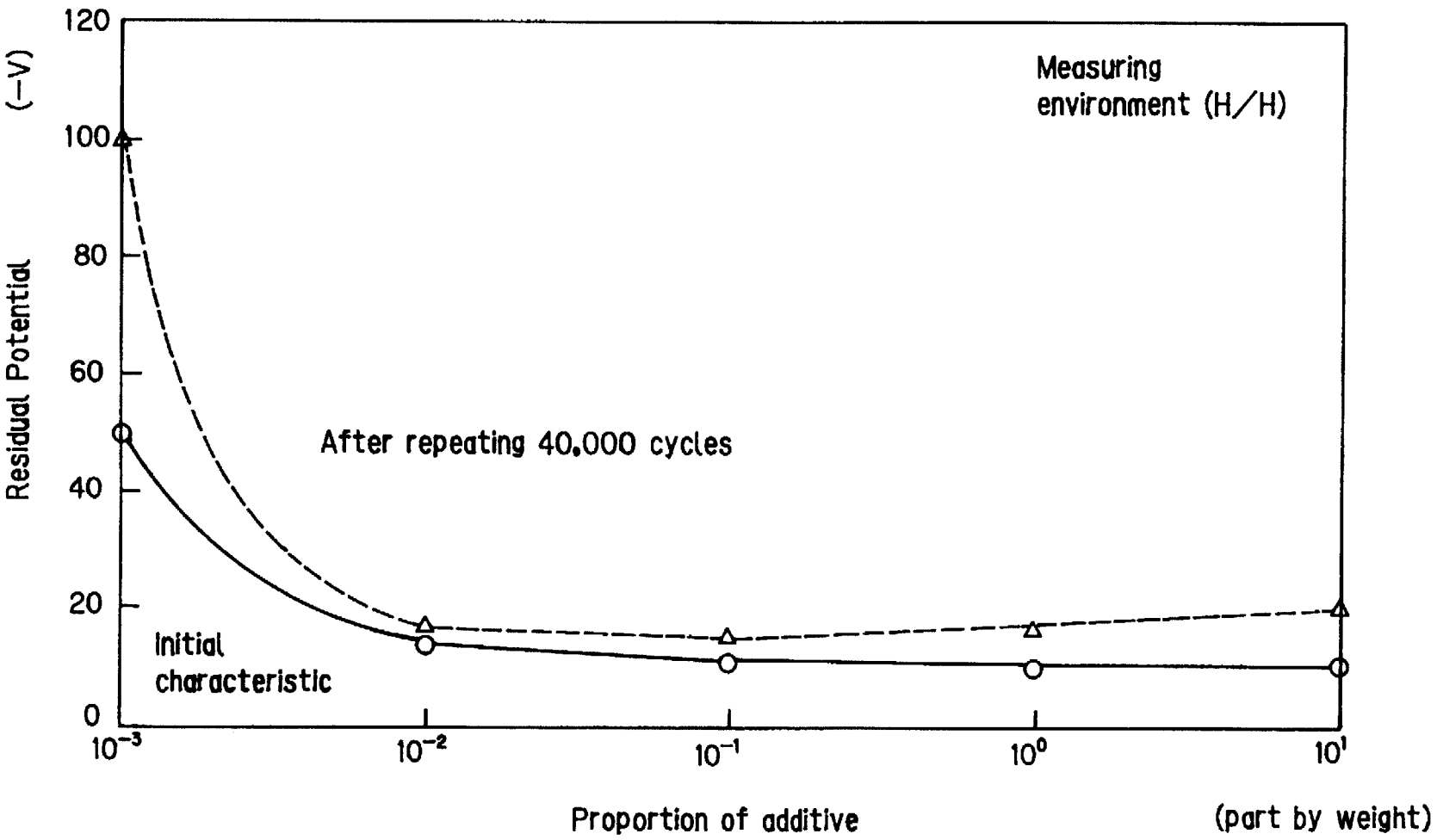
FIG. 3 is a diagram showing the measuring results of electrophotographic characteristics obtained in Example 2.

The results thereof are shown in FIG. 3.

Examples 3 to 7

The electrophotographic photoreceptors were prepared in the same manner as that in Example 1, except that the exemplified compounds 5, 6, 7, 13 and 14 represented by Formula (1) were employed instead of the fatty acid ester compound of the exemplified compound No. 12, and the electrophotographic characteristics were determined in the same manner as that in Example 1.

The results thereof are shown in Table 4.

TABLE 4

| Example | Fatty acid ester exemplified compound | Measuring environment | Initial (V) $V_O$ | Initial (V) $V_R$ | Initial (V) $V_L$ | After 40,000 cycles (V) $V_O$ | After 40,000 cycles (V) $V_R$ | After 40,000 cycles (V) $V_L$ |
|---|---|---|---|---|---|---|---|---|
| 3 | 5 | N/N | −710 | −6 | −142 | −704 | −7 | −138 |
| | | H/H | −726 | −10 | −135 | −721 | −16 | −131 |
| 4 | 6 | N/N | −711 | −6 | −144 | −707 | −7 | −132 |
| | | H/H | −727 | −11 | −127 | −723 | −17 | −133 |
| 5 | 7 | N/N | −712 | −6 | −142 | −703 | −7 | −140 |
| | | H/H | −727 | −10 | −128 | −721 | −14 | −137 |
| 6 | 13 | N/N | −713 | −7 | −142 | −704 | −9 | −137 |
| | | H/H | −727 | −12 | −132 | −722 | −15 | −134 |
| 7 | 14 | N/N | −709 | −4 | −146 | −706 | −6 | −135 |
| | | H/H | −722 | −11 | −133 | −718 | −16 | −130 |

Example 8

The mixture of a bisazo series pigment of 2 parts by weight represented by the following formula (IV) as a charge-generating material and polyvinylbutyral (XYHL: manufactured by Union Carbide Co., Ltd.) of 1 part by

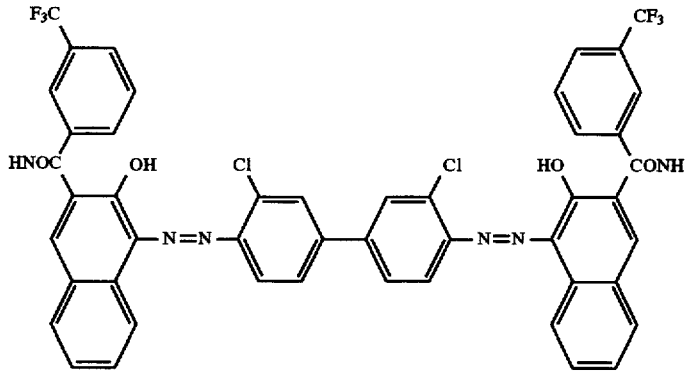

(IV)

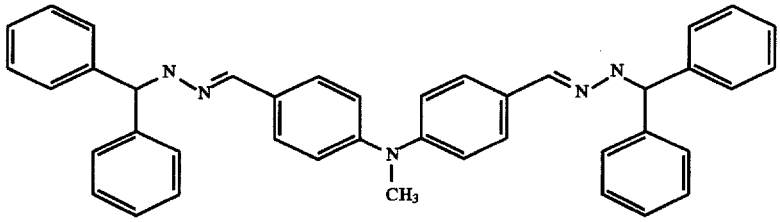

(V)

TABLE 5

| Example | Fatty acid ester exemplified compound | Measuring environment | Initial (V) $V_O$ | Initial (V) $V_R$ | Initial (V) $V_L$ | After 40,000 cycles (V) $V_O$ | After 40,000 cycles (V) $V_R$ | After 40,000 cycles (V) $V_L$ |
|---|---|---|---|---|---|---|---|---|
| 8 | 1 | N/N | −710 | −5 | −141 | −702 | −9 | −138 |
| | | H/H | −721 | −12 | −135 | −718 | −15 | −141 |

weight was dispersed in cyclohexanone of 97 parts by weight with the paint shaker to prepare a coating solution for a charge-generating layer. Further, the electrophotographic photoreceptor was prepared in the same manner as that in Example 1, except that the charge-transporting material was changed to a hydrazone series compound represented by the following formula (V), and the electrophotographic characteristics were determined in the same manner as that in Example 1.

The results thereof are shown in Table 5.

Example 9

A perylene series pigment of 2 parts by weight represented by the following formula (VI) was mixed with and dispersed in 1,2-dichloroethane of 98 parts by weight for 8 hours with the paint shaker. Then, a solution prepared by dissolving the hydrazone series compound of 100 parts by weight represented by the formula (V) described above, the polycarbonate (Eupiron Z-400: manufactured by Mitsubishi Gas Chemical Co., Ltd.) of 100 parts by weight and the fatty acid ester compound of the exemplified compound No. 12 of 0.1 part by weight in 1,2-dichloromethane of 800 parts by weight was added to the dispersion solution and dissolved by stirring with a magnetic stirrer. The resulting coating solution for a photoconductive layer was applied with the Baker applicator on a polyester film deposited with aluminum, and hot-air drying was carried out at a drying temperature of 80° C. for one hour, whereby a single layer type electrophotographic photoreceptor provided with a photoconductive layer having a dry film thickness of 15 μm was prepared as shown in FIG. 2.

The electrophotographic photoreceptor thus prepared was loaded in an experimental apparatus obtained by remodeling the commercial apparatus (SF-8870: manufactured by Sharp Co., Ltd.) to a positive charging type and was evaluated in the same manner as that in Example 1.

The results thereof are shown in Table 6.

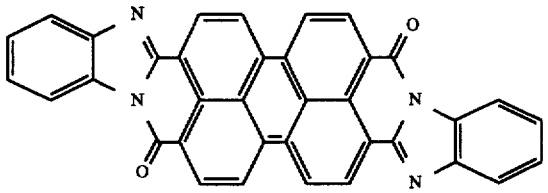

(VI)

TABLE 6

| Example | Fatty acid ester exemplified compound | Measuring environment | Initial (V) $V_O$ | $V_R$ | $V_L$ | After 40,000 cycles (V) $V_O$ | $V_R$ | $V_L$ |
|---|---|---|---|---|---|---|---|---|
| 9 | 12 | N/N | +700 | +30 | +142 | +680 | +40 | +138 |
| | | H/H | +723 | +35 | +135 | +692 | +50 | +141 |

Comparative Example 1

The electrophotographic photoreceptor was prepared in the same manner as that in Example 1, except that the fatty acid ester compound in Example 1 was not added, and the electrophotographic characteristics were determined in the same manner as that in Example 1.

The results thereof are shown in Table 7.

TABLE 7

| Comparative Example | Fatty acid ester exemplified compound | Measuring environment | Initial (V) $V_O$ | $V_R$ | $V_L$ | After 40,000 cycles (V) $V_O$ | $V_R$ | $V_L$ |
|---|---|---|---|---|---|---|---|---|
| 1 | None | N/N | −700 | −15 | −145 | −687 | −49 | −178 |
| | | H/H | −705 | −27 | −147 | −725 | −257 | −285 |

Comparative Example 2

The electrophotographic photoreceptor was prepared in the same manner as that in Example 1, except that a sulfonic acid ester compound represented by the following formula (VII) was employed instead of the fatty acid ester compound, and the electrophotographic characteristics were determined in the same manner as that in Example 1.

The results thereof are shown in Table 8.

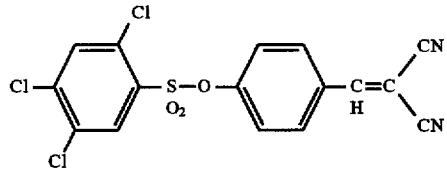

(VII)

TABLE 8

| Comparative Example | Measuring environment | Initial (V) $V_O$ | $V_R$ | $V_L$ | After 40,000 cycles (V) $V_O$ | $V_R$ | $V_L$ |
|---|---|---|---|---|---|---|---|
| 2 | N/N | −700 | −11 | −140 | −675 | −34 | −167 |
| | H/H | −705 | −22 | −142 | −690 | −150 | −241 |

What is claimed is:

1. An electrophotographic photoreceptor, comprising:

a conductive support; and a photoconductive layer provided on said conductive support and containing a charge-generating material, a charge-transporting material, a binder resin and a fatty acid ester compound represented by the following Formula (1):

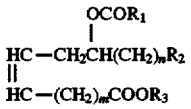

(1)

wherein $R_1$, $R_2$ and $R_3$ each independently represent hydrogen or or methyl, and n and m in each represent an integer of 1 to 10, wherein said fatty acid ester compound represented by Formula (1) is contained in said photoconductive layer in a range of 0.001 to 10 parts by weight based on 100 parts by weight of the binder resin contained in said photo conductive layer.

2. An electrophotographic photoreceptor according to claim 1, wherein said charge-generating material comprises: an inorganic photoconductive material selected from the group consisting of selenium, selenium alloys, arsenic-selenium, cadmium sulfide, zinc oxide, amorphous silicon and mixtures thereof; an organic pigment selected from the group consisting of phthalocyanines, azo pigments, quinacridone, polycyclic quinones, perylene and mixtures thereof; or a dye selected from the group consisting of pyrylium salts, thiapyrylium salts, squalilium salts, indigo, thioindigo, anthanthrone, pyranthrone, cyanines and mixtures thereof.

3. An electrophotographic photoreceptor according to claim 1, wherein said charge-transporting material comprises: a heterocyclic compound selected from the group consisting of carbazole, indole, imidazole, oxazole, pyrazole, oxadiazole, pyrazoline, thiadiazole and mixtures thereof; aniline derivatives; hydrazone compounds; aromatic amine derivatives; stilbene derivatives; polymers having groups comprising these compounds on main chains or side chains; or mixtures thereof.

4. An electrophotographic photoreceptor according to claim 1, wherein the binder resin contained in said photoconductive layer is selected from the group consisting of polymethyl methacrylate, polystyrene, polyvinyl chloride, copolymers thereof, polycarbonate, polyester resins, polyester carbonates, polysulfones, polyimides, phenoxy resins, epoxy resins, silicone resins, mixtures thereof and partially cross-linked polymers thereof.

5. An electrophotographic photoreceptor according to claim 1, wherein said charge-transporting material is contained in said photoconductive layer in a range of 30 to 200 parts by weight based on 100 parts by weight of the binder resin contained in said photoconductive layer.

6. An electrophotographic photoreceptor according to claim 1, wherein a barrier layer is provided between said conductive support and said photoconductive layer, and said barrier layer is: an inorganic layer comprising an inorganic compound selected from the group consisting of an aluminum anodic oxide film, aluminum oxide, aluminum hydroxide, titanium oxide and mixtures thereof; an organic layer comprising an organic polymer selected from the group consisting of polyvinyl alcohol, casein, polyvinylpyrrolidone, polyacrylic acid, celluloses, gelatin, starch, polyurethane, polyimides, polyamides and mixtures thereof; or a layer comprising the mixtures of said inorganic compound and said organic polymer.

7. An electrophotographic photoreceptor according to claim 1, wherein said photoconductive layer has a thickness of 5 to 50 μm.

8. An electrophotographic photoreceptor, comprising:

a conductive support; and a photoconductive layer provided on said conductive support, and said photoconductive layer comprising:

a charge-generating layer which contains a charge-generating material; and a charge-transporting layer which contains a charge-transporting material, a binder resin and a fatty acid ester compound represented by the following Formula (1):

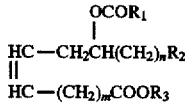

(1)

wherein $R_1$, $R_2$ and $R_3$ each independently represent hydrogen or methyl, and n and m in each represent an integer of 1 to 10, wherein said fatty acid ester compound represented by Formula (1) is contained in said photoconductive layer in a range of 0.001 to 10 parts by weight based on 100 parts by weight of the binder resin contained in said photoconductive layer.

9. An electrophotographic photoreceptor according to claim 8, wherein said charge-generating material comprises: an inorganic photoconductive material selected from the group consisting of selenium, selenium alloys, arsenic-selenium, cadmium sulfide, zinc oxide, amorphous silicon and mixtures thereof; an organic pigment selected from the group consisting of phthalocyanines, azo pigments, quinacridone, polycyclic quinones, perylene and mixtures thereof; or a dye selected from the group consisting of pyrylium salts, thiapyrylium salts, squalilium salts, indigo, thioindigo, anthanthrone, pyranthrone, cyanines and mixtures thereof.

10. An electrophotographic photoreceptor according to claim 8, wherein said charge-generating layer contains a binder resin selected from the group consisting of polyvinyl acetate, polyacrylic acid ester, polymethacrylic acid ester, polyester resins, polycarbonate, polyarylate, polyvinylbutyral, phenoxy resins, epoxy resins, urethane resins, cellulose esters, cellulose ethers and mixtures thereof.

11. An electrophotographic photoreceptor according to claim 10, wherein said charge-generating material is contained in said charge-generating layer in a range of 1 to 500 parts by weight based on 100 parts by weight of the binder resin contained in said charge-generating layer.

12. An electrophotographic photoreceptor according to claim 8, wherein said charge-transporting material comprises: a heterocyclic compound selected from the group consisting of carbazole, indole, imidazole, oxazole, pyrazole, oxadiazole, pyrazoline, thiadiazole and mixtures thereof; aniline derivatives; hydrazone compounds; aromatic amine derivatives; stilbene derivatives; polymers having groups comprising these compounds on main chains or side chains; or mixtures thereof.

13. An electrophotographic photoreceptor according to claim 8, wherein the binder resin contained in said charge-transporting layer is selected from the group consisting of polymethyl methacrylate, polystyrene, polyvinyl chloride, copolymers thereof, polycarbonate, polyester resins, polyester carbonates, polysulfones, polyimides, phenoxy resins, epoxy resins, silicone resins, mixtures thereof and partially cross-linked polymers thereof.

14. An electrophotographic photoreceptor according to claim 13, wherein said charge-transporting material is contained in said charge-transporting layer in a range of 30 to 200 parts by weight based on 100 parts by weight of the binder resin contained in said charge-transporting layer.

15. An electrophotographic photoreceptor according to claim 8, wherein a barrier layer is provided between said conductive support and said photoconductive layer, and said barrier layer is: an inorganic layer comprising an inorganic compound selected from the group consisting of an aluminum anodic oxide film, aluminum oxide, aluminum hydroxide, titanium oxide and mixtures thereof; an organic layer comprising an organic polymer selected from the group consisting of polyvinyl alcohol, casein, polyvinylpyrrolidone, polyacrylic acid, celluloses, gelatin, starch, polyurethane, polyimides, polyamides and mixtures thereof; or a layer comprising the mixtures of said inorganic compound and said organic polymer.

16. An electrophotographic photoreceptor according to claim 8, wherein said charge-generating layer has a thickness of 0.05 to 5 μm.

17. An electrophotographic photoreceptor according to claim 8, wherein said charge-transporting layer has a thickness of 5 to 50 μm.

* * * * *